US007673907B2

(12) United States Patent
Nenov et al.

(10) Patent No.: US 7,673,907 B2
(45) Date of Patent: Mar. 9, 2010

(54) MUSICAL ICE SKATES

(76) Inventors: Valeriy Nenov, 6597 Kentwood Bluffs Dr., Los Angeles, CA (US) 90045; Xiao Hu, 3767 Mentone #305, Los Angeles, CA (US) 90034; Marie-Laure Leglise, 10650 Kinnard Ave. #304, Los Angeles, CA (US) 90024

( * ) Notice: Subject to any disclaimer, the term of this patent is extended or adjusted under 35 U.S.C. 154(b) by 666 days.

(21) Appl. No.: 11/400,916

(22) Filed: Apr. 8, 2006

(65) Prior Publication Data

US 2007/0235957 A1 Oct. 11, 2007

(51) Int. Cl.
*A63C 1/00* (2006.01)
*G10H 3/00* (2006.01)

(52) U.S. Cl. ..... 280/811; 84/718

(58) Field of Classification Search ..... 280/280, 280/11.19, 11.25, 11.12, 600, 14.21, 811, 280/816

See application file for complete search history.

(56) References Cited

U.S. PATENT DOCUMENTS 4,043,241 A * 8/1977 Liu ..... 36/139
4,771,556 A * 9/1988 Kim ..... 36/139
5,107,746 A * 4/1992 Bauer ..... 84/626
5,130,693 A * 7/1992 Gigandet ..... 340/815.69
5,234,230 A * 8/1993 Crane et al. ..... 280/811
D354,787 S * 1/1995 Stiles ..... D21/764
5,461,188 A * 10/1995 Drago et al. ..... 84/600
5,516,149 A * 5/1996 Moore ..... 280/811
5,615,111 A * 3/1997 Raskas et al. ..... 36/136
5,765,300 A * 6/1998 Kianka ..... 36/139
5,855,382 A * 1/1999 Reilly et al. ..... 280/11.19
5,894,686 A * 4/1999 Parker et al. ..... 36/137
5,921,653 A * 7/1999 Chien ..... 362/103
6,000,149 A * 12/1999 Pomerantz ..... 36/139
6,005,181 A * 12/1999 Adams et al. ..... 84/734
6,234,532 B1 * 5/2001 Kollen ..... 280/841
6,240,190 B1 * 5/2001 Huang ..... 381/61
6,315,571 B1 * 11/2001 Lee ..... 434/250
6,332,692 B1 * 12/2001 McCurdy ..... 362/103
6,428,050 B1 * 8/2002 Brandley et al. ..... 280/809
7,019,206 B2 * 3/2006 Mishima ..... 84/723
7,053,288 B2 * 5/2006 Iwai et al. ..... 84/600
7,059,739 B2 * 6/2006 Wong ..... 362/103
7,114,822 B2 * 10/2006 Guzman ..... 362/103
7,156,773 B2 * 1/2007 Takai et al. ..... 482/7
2005/0029247 A1 * 2/2005 Furzer et al. ..... 219/490
2005/0029766 A1 * 2/2005 Ierfone et al. ..... 280/87.042
2005/0258629 A1 * 11/2005 Jennings et al. ..... 280/811
2006/0041425 A1 * 2/2006 Smulson ..... 704/200
2008/0034949 A1 * 2/2008 Nishitani et al. ..... 84/735

* cited by examiner

*Primary Examiner*—Paul N Dickson
*Assistant Examiner*—Chiedu A Chibogu
(74) *Attorney, Agent, or Firm*—Clement Cheng

(57) ABSTRACT

An electronic music device for skaters is boot mounted and includes a sensor sensing skate states capturing forward backward direction of motion and inside outside lean. A sensory signal conditioning and calibration circuit converts mapped signals into audible tones. An audio amplifier powers wired or wireless headphones. The skater plays music with skates like a musician plays music on a musical instrument. The device tuned as different musical instruments, in a synchronized precision skating team allows musical composition performance. The skaters play the music with their skates creating musical and choreographic dance.

7 Claims, 6 Drawing Sheets

| Code | Meaning | Code | Meaning |
|---|---|---|---|
| 3 | Three turn | op | open |
| B | Backward -- direction of travel | ov | over |
| B | Behind – relation of feet | Pr | Progressive |
| BKWD | Backward direction of free foot | R | Right (foot) |
| Br | Bracket | Rk/Roc | Rocker |
| CE | Change Edge | S | Stroke |
| Ch | Chasse | SC | Slight Change of edge |
| Cho | Choctaw | Seq. | Sequence of steps |
| cl | closed | Siz | Scissors |
| Ctr | Counter | sl | slide |
| Dbl | Double (turn) | SR | Swing Roll |
| dr3 | dropped Three turn | sw | swing |
| F | Forward -- direction of travel | Twz | Twizzle |
| F | (in) Front – relation of feet | Wlz 3 | Waltz Three turn |
| FWD | Forward – direction of free foot | X | cross |
| I | Inside edge | XB | cross step behind |
| L | Left (foot) | XF | cross step in front |
| Mo | Mohawk | XR | cross Roll |
| O | Outside (edge) | XS | cross Stroke |

Fig. 3

| **Notes \ Edges** | **1** | **2** | **3** | **4** | **5** | **6** | **7** | **8** |
|---|---|---|---|---|---|---|---|---|
| **1 Do (C)** | **LFO** | LFO | LFO | LFO | LBI | LBI | LBI | LBI |
| **2 Re (D)** | **RFI** | RBO | RFI | RBO | RBO | RFI | RBO | RFI |
| **3 Mi (E)** | **LBI** | LBI | LBI | LBI | LFO | LFO | LFO | LFO |
| **4 Fa (F)** | **RBO** | RFI | RBO | RFI | RFI | RBO | RFI | RBO |
| **5 Sol (G)** | **LBO** | LFI | LFI | LBO | LBO | LFI | LFI | LBO |
| **6 La (A)** | **RBI** | RBI | RBI | RBI | RBI | RBI | RBI | RBI |
| **7 Ti (B)** | **LFI** | LBO | LBO | LFI | LFI | LBO | LBO | LFI |
| **8 Do' (C')** | **RFO** | RFO | RFO | RFO | RFO | RFO | RFO | RFO |

Fig. 4

| **Turns:** on Left foot (Do, Mi, So, Ti) and on Right foot (Re, Fa, La, Do') | | |
|---|---|---|
| **On Left foot (OTO notes)** | **On Right foot (ETE notes)** | **Moves (turns)** |
| LFO (Do) → LFO (Do) | RFI (Re) → RFI (Re) | sw |
| LFO (Do) → LBI (Mi) | RFI (Re) → RBO (Fa) | 3 \| Br |
| LFO (Do) → LBO (Sol) | RFI (Re) → RBI (La) | Ctr \| Roc |
| LFO (Do) → LFI (Ti) | RFI (Re) → RFO (Do') | CE |
| LBI (Mi) → LFO (Do) | RBO (Fa) → RFI (Re) | 3 \| Br |
| LBI (Mi) → LBI (Mi) | RBO (Fa) → RBO (Fa) | sw |
| LBI (Mi) → LBO (Sol) | RBO (Fa) → RBI (La) | CE |
| LBI (Mi) → LFI (Ti) | RBO (Fa) → RFO (Do') | Ctr \| Roc |
| LBO (Sol) → LFO (Do) | RBI (La) → RFI (Re) | Ctr \| Roc |
| LBO (Sol) → LBI (Mi) | RBI (La) → RBO (Fa) | CE |
| LBO (Sol) → LBO (Sol) | RBI (La) → RBi (La) | sw |
| LBO (Sol) → LFI (Ti) | RBI (La) → RFO (Do') | 3 \| Br |
| LFI (Ti) → LFO (Do) | RFO (Do') → RFI (Re) | CE |
| LFI (Ti) → LBI (Mi) | RFO (Do') → RBO (Fa) | Ctr \| Roc |
| LFI (Ti) → LBO (Sol) | RFO (Do') → RBI (La) | 3 \| Br |
| LFI (Ti) → LFI (Ti) | RFO (Do') → RFO (Do') | sw |
| **Steps:** from Left foot (Do, Mi, So, Ti) to Right foot (Re, Fa, La, Do') & v.v. | | |
| **Left to Right foot (OTE)** | **Right to Left foot (ETO)** | **Moves (steps)** |
| LFO (Do) → RFI (Re) | RFI (Re) → LFO (Do) | Pr \| Ch |
| LFO (Do) → RBO (Fa) | RFI (Re) → LBI (Mi) | opMo \| clMo |
| LFO (Do) → RBI (La) | RFI (Re) → LBO (Sol) | opCho \| clCho |
| LFO (Do) → RFO (Do') | RFI (Re) → LFI (Ti) | S |
| LBI (Mi) → RFI (Re) | RBO (Fa) → LFO (Do) | opMo \| clMo |
| LBI (Mi) → RBO (Fa) | RBO (Fa) → LBI (Mi) | Pr \| Ch |
| LBI (Mi) → RBI (La) | RBO (Fa) → LBO (Sol) | S |
| LBI (Mi) → RFO (Do') | RBO (Fa) → LFI (Ti) | opCho \| clCho |
| LBO (Sol) → RFI (Re) | RBI (La) → LFO (Do) | opCho \| clCho |
| LBO (Sol) → RBO (Fa) | RBI (La) → LBI (Mi) | S \| XS |
| LBO (Sol) → RBI (La) | RBI (La) → LBO (Sol) | Pr \| Ch |
| LBO (Sol) → RFO (Do') | RBI (La) → LFI (Ti) | opMo \| clMo |
| LFI (Ti) → RFI (Re) | RFO (Do') → LFO (Do) | S \| XS |
| LFI (Ti) → RBO (Fa) | RFO (Do') → LBI (Mi) | opCho \| clCho |
| LFI (Ti) → RBI (La) | RFO (Do') → LBO (Sol) | opMo \| clMo |
| LFI (Ti) → RFO (Do') | RFO (Do') → LFI (Ti) | Pr \| Ch |

Fig. 5

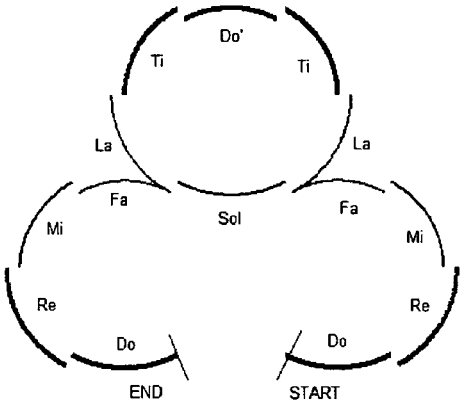
Fig. 6
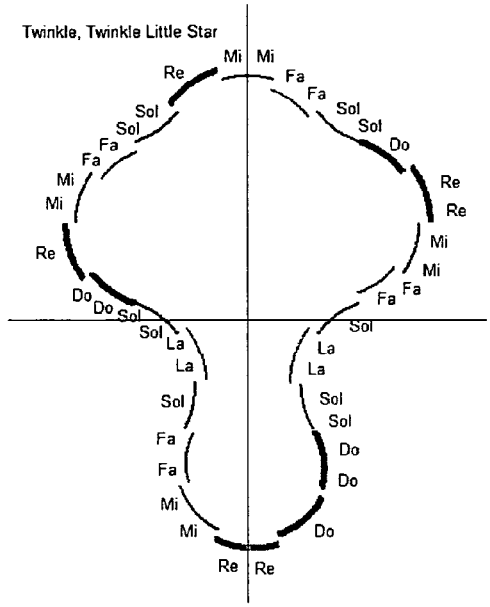
Fig. 6a
| Level | Angle (degrees) | Notation | Description | Relative loudness |
|---|---|---|---|---|
| 1 | 45 | fff | Fortississimo | Super loud |
| 2 | 40 | ff | Fortissimo | Very loud |
| 3 | 35 | f | Forte | Strong |
| 4 | 30 | mf | Mezzo-forte | Half-strong |
| **5** | **25** | **n** | **normal** | |
| 6 | 20 | mp | Mezzo-piano | Half quiet |
| 7 | 15 | p | piano | Softly, quietly |
| 8 | 10 | pp | pianissimo | Very softly |
| 9 | 5 | ppp | pianississimo | Almost audible |
Fig. 7

MUSICAL ICE SKATES

BACKGROUND OF THE INVENTION

A. Field of the Invention

The present invention relates to a musical instrument based on skates. More particularly, the present invention relates to a device attached to figure skates for transforming a physical performance into electronic sounds, notes and music.

B. Discussion of Related Art

Previous advances in figure skating and other skating disciplines have been achieved through improved equipment, better coaching, sports medicine and psychology and appropriate nutrition. In figure skating, primary emphasis is commonly placed on the use of training techniques and fixed equipment intended to reinforce the skater's proper upper and lower body position, and the use of the skater's muscle memory. To date, skaters have relied on the ability of a coach to observe their movements and suggest or demonstrate steps for improvement. Feedback from a coach requires frequent and intensive coach time.

Since its invention in the last century, skating has been analogous to silent movies. Live or mostly prerecorded music accompanies a skating performance both in the competitive and the entertainment world of skating. All skaters skate to prerecorded music when they perform. Ice dancers and synchronized skating teams, for instance are judged on the precision with which they interpret the music. For single free style skaters and for pair skaters the music is often treated as required accompaniment with few interspersed musical crescendos when the skaters jump or spin. However, no matter what the event is, skaters in all cases skate to the music.

It is well known, however that during skating the blades generate sounds. Unfortunately, these sounds are nothing more than scrapes, whistles or toe pick scratches that are not particularly entertaining. In fact, skating as quietly as possible is considered by most skating professionals to represent quality skating.

A variety of devices, which use the feet, hands and fingers or other body parts of a dancer, to control musical instruments have been demonstrated, published, and patented in the past. Most of them are associated with gloves, shoes and other types of footwear. However, there have been no such devices that use skates as the source of music. Examples are seen in the following U.S. patents: U.S. Pat. No. 4,660,305 to Medler; U.S. Pat. No. 5,911,650 to Cox; U.S. Pub. No. 2005/0153265 (Kavana); U.S. Pat. No. D488,284 to Kavana, etc.

In the Tap-Tronic invention http://www.usc.edu/dept/dance/p3_more.html#ZT Alfred Desio described the Zapped Taps, Tap-Tronics™. In his concept, each dancer used electronically amplified tap shoes. Transducer microphones in a tapper's shoes were wired to a transmitter either hand-held or placed in a pocket. The tap sounds were relayed to a receiver and could go through special effects modules, a number of synthesizers, and other electronic equipment. There was a special effect due to performance: the music was developed and changed by the dancer at the moment that the dance took place. Basic elements included the tap sounds, any electronic devices, and the material that the composer had pre-programmed into the sequence.

In the 1987 U.S. Pat. No. 4,660,305 "Tap dance shoe including integral electromechanical energy conversion means", the inventors Charles E. Medler and Terry C. McInturff featured a tap attachment to a tap dancing shoe. The tap included pickup means for converting the mechanical vibration energy generated by the tap striking the floor into a substantially undistorted electrical signal suitable for remote processing and amplification. Also disclosed was a wireless radio transmission system adapted for carrying by a dancer using the shoe whereby the electrical signals picked up by the pickup means are transmitted to a remote receiver/amplifier unit.

In 1999, "Ice skating simulator apparatus and method of using same" by Cox received U.S. Pat. No. 5,911,650, the disclosure of which is incorporated herein by reference. This invention is concerned with a skating apparatus for facilitating replication of a skating stride, comprising a support surface with a pair of pivotable simulator arms. Each pivotable simulator arm supports a foot portion that is slidable along the pivotable simulator arm in a guide track. The foot portions are coupled to a resistance mechanism, via a chain, to provide resistance to the foot portions during a skating stride. The resistance mechanism includes a retraction device for retracting a chain during the return stroke of the foot portion. While this invention provides tactile feedback to the skater with the purpose of improving her skating skills, it does not have means to convert this feedback to music. Variations of the Cox patent are found in U.S. Pat. Nos. 4,955,608 and 6,551,221, the disclosures of which is incorporated herein by reference.

In 2005, "Entertainment device" of Jordan Kavana was published under US Patent Pub. No. 2005/0153265. The invention describes an interactive entertainment device that can be used as a karaoke machine, a dance teaching aide, a combination of a karaoke machine and dance teaching aide, a competition device, and others. The interactive entertainment device may include a central processing unit, a dance mat having one or more sensors for receiving input from a user, a display device for displaying words of songs, one or more input devices, such as microphones, and one or more speakers for playing songs.

In 2004, "Virtual reality musical glove" by Kavana received U.S. Design Pat. No. D488,284. Also by the same inventor is provided the design of gloves, which are commercially available as the "HandBand", a virtual musical instrument that uses the bending of the fingers connected with strings to micro-switches to control a wirelessly connected music synthesizer capable of playing tunes and other special effects.

In several Ice Skating shows including the 1998-1999 "Stars on Ice" Olympic champion Ilia Kulik performed a couple of unusual programs choreographed by Sarah Kawahara ("Noise" and "Bring in da Noise, Bring in da Funk") in which he used his natural musicality and his stroking ability to always match his prerecorded music beat for beat. With microphones on his hands and feet he added skating sound effects to his skating. His blades tapped and swooshed out intricate rhythmic vignettes that were musically complex and visually awesome, building in intensity to an incredible finish (Miriam Ellis). See websites http://p 198.ezboard.com/fkulikskrewonlineform8.showMessage?topicID=723.topic http://www.kuliks-krew.com/Kulik_programs/noise5.shtml Other related publications are:

John Kymissis et al., "Parasitic Power Harvesting in Shoes," Presented at the Second IEEE International Conference on Wearable Computing, IEEE Computer Society Press, pp. 132-139, October, 1998.

N. Shenck, J. Paradiso, "Energy Scavenging With Shoe-Mounted Piezoelectrics," IEEE Micro, vol. 21, No. 3, May-June 2001, pp. 30-42.

Joe Paradiso's system description in 2001 states "We have instrumented a pair of dancing sneakers to each measure 16 different parameters, including continuous pressure at 2 points in the sole below left and right toes, continuous pressure at the front of the shoe for pointing, dynamic pressure below the heel, bi-directional bend of the sole, orientation about the 'magnetic vertical' (a 3-axis solid-state compass), tilt in two axes (a low-G MEMs accelerometer), high-G's/shock in 3 axes (a piezoelectric accelerometer), angular rate about the vertical (a vibrating reed rate gyro), height above electric field transmitters in the stage, translational position (sonar from 4 separate locations), and battery status (continuous level and discrete warning). All sensors reside on the shoe itself, together with a PIC microcomputer to sample and serialize the data, an FM wireless transmitter to broadcast updates (at up to 20 kbits/sec, giving us a 350 Hz state update from both shoes) and a 9-volt battery that lasts a day or so." http://www.media.mit.edu/resenv/pubs/papers/2000_12_ISEA_Shoe.pdf presents Joe Paradiso's dance shoe personal reflections including a vision of an orchestra performing music while using these musical sneakers. Paradiso Expressive footwear is for computer-augmented dace performance. See http://www.media.mit.edu/resenv/pubs/papers/97_10_Wearcon_Shoe.pdf.

In 1997, Yamaha introduced its Miburi system, consisting of a vest hosting an array of resistive bend sensors at the shoulder, elbows, and wrist, a pair of handgrips with two velocity-sensitive buttons on each finger, and a pair of shoe inserts with piezoelectric pickups at the heel and toe. It is the most advanced wearable musical interface to have hit the commercial music world. See website http://web.media.mit.edu/~joep/SpectrumWeb/captions/Miburi.html. The most recent models employ a wireless data link between a belt-mounted central controller and a nearby receiver/synthesizer unit. Yamaha has invented a semaphore-like gestural language for the Miburi, where notes are specified through a combination of arm configurations and key presses on the wrist controllers. Degrees of freedom not used in setting the pitch are routed to timbre-modifying and pitch-bending continuous controllers.

Sonic Banana is a bend sensor midi controller with good references on Miburi and Paradiso's shoes. See http://www.i-ua.upf.es/mtg/reacTable/musictables/singer_sonicbanana.pdf.

In a paper "Towards a choice of gestural constraints for instrumental performers" Axel Mulder discusses many of the conceptual issues related to a successful mapping of the musician's gestures to the performance of music using various musical instruments. See http://www.tufts.edu/programs/mma/emid/IRCAM/Mul.pdf.

Although the foregoing devices may be well suited for their respective purposes, they either involve microphones to capture the natural sounds produced by the skates or tap shoes or use sensors that are suited to capture the movement of the foot while dancing on a dance floor and map these movements to arbitrary sounds.

OBJECTIVES OF THE INVENTION

Therefore, it is an objective of the present invention to provide a training device for the figure skater, which enables the user to get audio feedback reflecting the quality of skating such as the dept and control over the skating edge. The present invention can to a large extent augment or even substitute the feedback from a coach especially in the early stages of the skaters' training in which the skater learns about the quality of the edges.

Another objective is to provide an athletic training device that can be attached quickly and conveniently to a user's skate boot, and that is simple and easy to use in practicing a wide variety of skating moves including three-turns, Mohawks, Choctaws, rockers, counters, brackets, twizzles, etc.

A further objective is to provide a process for practicing skating moves, which matches one-to-one skating moves to musical notes and affords freedom of movement, yet gives the user immediate feedback and encouragement toward correct relative positioning of the skates for each move being practiced.

Yet another objective is to provide a training device that can be used for personal training as well as for solo, dance couple or pair skaters, and even entire synchronized team performances of musical pieces.

SUMMARY OF THE INVENTION

To achieve these and other objectives, there is provided an electronic musical device for figure skaters and athletes in other sports such as inline skating, skateboarding, roller skating, and skiing. The device is mounted on the boots or skate blades and includes a sensor assembly that senses the contact of the skate blade with the ice and captures the forward/backward (F/B) motion direction and inside/outside (I/O) lean state of the skate gliding on ice with respect to the ice surface of a skating rink. A sensory signal conditioning and calibration circuit feeds the conditioned signals into a logic circuit that encodes the afore-mentioned states into a limited, discrete number of states of the skating edge. For example, a Left-Forward-Outside (LFO) edge, a Right-Backward-Inside (RBI) edge, etc. The logic circuit has a mapping of these states to musical notes (Do, Re, Mi, etc.). An electronic music synthesizer Integrated Circuit (IC) and associated coupling electronics converts the mapped signals into audible musical tones that can sound like any kind of musical instrument (e.g., music keyboard, piano, organ guitar, violin, trombone, drums, etc.). An audio amplifier powers wired or wireless headphones designed for personal experience such as audio feedback during skating. The music created by the skater can be heard throughout the entire rink by a wireless remote audio system or powered speakers mounted on the boots. Wireless protocols are numerous and any may be used. The audience throughout the entire rink can hear the sound from the skates. Less powerful speakers mounted on the shoulders of the skater may enable the single skater or dance couples and pairs partners to hear the music while not disturbing other skaters at the rink.

The device, which is introduced here, empowers skaters by allowing them to capture many of the most essential degrees of freedom of their skates and convert them to musical experiences. This musical device is mounted on the skate under the boot and when connected to an electronic system, it allows skaters to play and listen to their skates. The device can be used for a skater's daily practices for training purposes and also during competitions and performances. In fact, it can open a whole new dimension of competitive and entertainment oriented skating. One can envision skating concerts featuring performances of single skaters, pairs, dance couples or entire precision teams. Skaters may create their own music to be broadcasted while dancing instead of interpreting prerecorded music. Performances would require both musical and skating practice. The device may allow skaters to listen to their skates and learn how to skate with better quality of their edges and with better musical timing.

The capability of the musical skates to play music is based on a one-to-one mapping of the natural gliding states of the skates including RFO, LBI, RBO, etc. to musical scale notes such as Do, Re, Mi, etc. More generally, the relative position of the left and right foot skates can be mapped to musical notes which can cover one or more octaves including both notes and half notes.

During skating, the device provides a real-time audio feedback from the skating edges allowing for immediate edge correction. The present training device uses a combination of the direction of motion with respect to the ice and the direction of lean of the skating blade to drive the music synthesizer. There is a set of triggering thresholds associated with the direction of motion and lean, which can be set so that the gliding skate does not produce any sound while moving in a straight and level fashion either forward or backward or when the skater does not move but the gliding edge triggers musical notes when the skater is performing any edge-based moves on the ice.

The present athletic training device is comfortable to wear, quick and easy to attach, and simple and uncomplicated to use. This enhances the potential of the device to increase the skater's awareness of posture, bend, lean, and extension, while avoiding unnecessary restrictions on the movement of the skater as he or she engages in a wide variety of moves in the filed.

The sensory module is preferably attached to the blade with a spring-loaded plastic bracket designed to fit on any skate make and model. The electronics module is preferably attached to the outside of each boot by a hook and loop strip wrapped around and under the boot. It is used to secure the device from sliding. The hook and loop strip color and the device housing can match or contrast the boot color depending on skater personal preference.

The skating states can be mapped to notes so that consecutive notes in an octave of a music scale are associated with different skating feet. Although an octave embodiment (C Major) is described herein, other type of scales such as Chromatic, Minor (Natural and Harmonic), Minor Melodic (Ascending and Descending), Hole Tone, Pentatonic, Octatonic, and others would be obvious in light of the foregoing disclosure. By definition, the skating foot is the foot that glides on the ice while the free foot is the foot in the air. Most of the time the objective of the skater is to be on one foot and two-footing is explicitly undesirable especially in ice dancing. In this sense the device can be used to teach the skater to avoid two-footing. Specifically, the proposed mapping which we will refer to as the Natural Musical Order of Skating (NMOS) is as follows:

1. Left Forward Outside (LFO) edge is mapped to the note Do (C4)
2. Right Forward Inside (RFI) edge is mapped to the note Re (D4)
3. Left Backward Inside (LBI) edge is mapped to the note Mi (E4)
4. Right Backward Outside (RBO) edge is mapped to the note Fa (F4)
5. Left Backward Outside (LBO) edge is mapped to the note Sol (G4)
6. Right Backward Inside (RBI) edge is mapped to the note La (A5)
7. Left Forward Inside (LFI) edge is mapped to the note Ti (B5)
8. Right Forward Outside (RFO) edge is mapped to the note Do' (C5)

Embodiments of the invention will now be described by way of example with reference to the accompanying drawings.

BRIEF DESCRIPTION OF THE DRAWINGS

FIG. 3 is a table of common abbreviations used to represent skating terminology used throughout this document.

FIG. 4 is a table of the best mode of mapping as well as alternative mappings of the skating states to musical output.

FIG. 5 is a table showing one-foot skating turns such as three-turns, rockers, counters, brackets and changes of lean, that allow a skater to transition between two even notes such as any pair of the Re, Fa, La, Do' notes or two odd notes such as any pair form the Do, Mi, Sol, Ti notes in an octave. FIG. 5 also illustrates the steps from one foot to the other such as Mohawks and Choctaws, progressives, chasses, and simple strokes, enabling the skater to transition between an even numbered note such as Re, Fa, La, Do' and an odd numbered note such as Do, Mi, Sol, Ti in an octave.

FIG. 6 shows a skating pattern in which the skater plays the C Major musical scale from Do (C4) to Do'(C5) and back in a 4/4 tango or foxtrot like rhythm. FIG. **6*a*** shows the dance pattern of the popular children's lullaby "Twinkle, Twinkle Little Star" generated by means of the NMOS rules for mapping of notes to edges and plotted by the software described in this document.

FIG. 7 is a table of a possible correlation of skate angle with loudness notation. Similar reference numbers denote corresponding features throughout the attached drawings.

DETAILED DESCRIPTION OF THE PREFERRED EMBODIMENT

Figure 1:
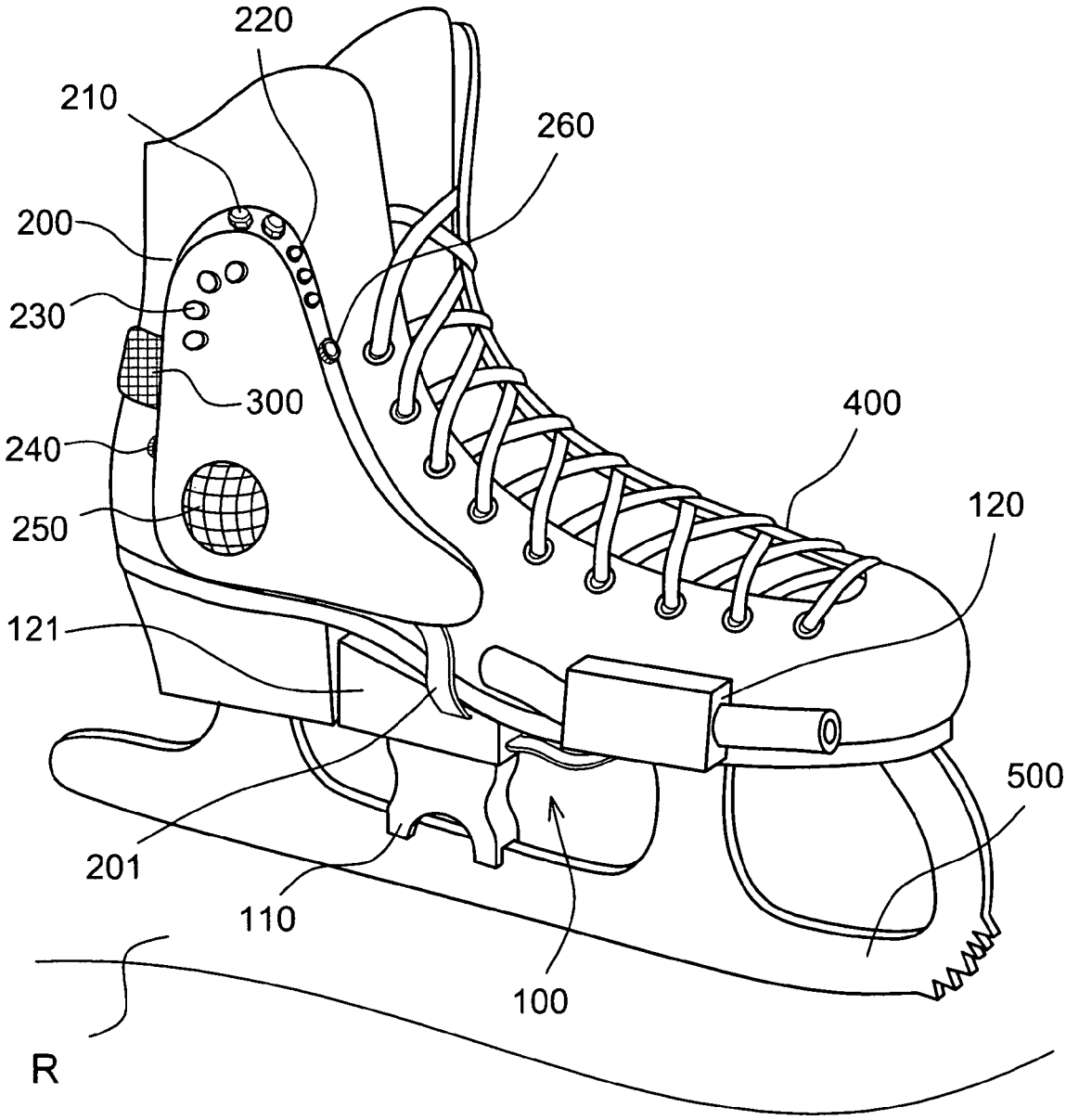
FIG. 1 is a perspective view of the musical skate including the sensors and electronics attached to the outside of the skate.

As seen in FIG. 1, the musical skate described is in the form of a retrofit kit that can be strapped onto any existing ice skate or roller blade. With further modifications, it can be implemented on ski boots or a skateboard. It is obvious that the retrofit kit can be modified to be an integrated boot so that it can be made and sold as a single unit of manufacture.

The skate 100 is a right foot skate. A front and back movement sensor 120 is attached to the skate 100. The movement sensor 120 can be formed as a differential pressure sensor that monitors forward pressure in a tube with an opening facing the forward direction and another rearward tube mounted facing the rear. When the sensor is receiving an air pressure difference, it translates this as moving forward or backward. The forward/backward movement sensor 120 can also be implemented in a variety of other means such as by optical scanning of the ice (ground), radar, radio, infrared, anemometer, mechanical or by any other convenient means.

A cable electrically connects the motion sensor 120 to the remainder of the devices. The blade bracket 110 attaches as a clip to the blade and supports a lean sensor(s). The lean sensor(s) 121 is preferably an infrared detector monitoring the distance between the sensor 121 and the ice surface. The infrared detector may have an outside sensor mounted on the right side of the right boot and an inside sensor mounted on the left side of the right boot. The infrared sensors are pointed at the ice to monitor tilt. Tilt can also be measured using a variety of methods such as by optical scanning, radar, radio, infrared, mechanical or other means.

The tilt or lean sensor 121 has another cable 201 and makes electrical connection to the remainder of the device. The cable 201 has electrical connection to a logical module 200 that may contain a number of integrated circuits and central processing units. The module 200 preferably has a speaker 250 to produce sound, a battery charging jack 240 for convenient charging, a strap 300 preferably of hook and loop tape. The module should also include synthesizer controls 230 as well as other controls mounted on the assembly 200. The module 200 also has sensor calibration controls 210 shown as a knob. Additionally, solid state LED lamps 220 can assist in calibration and indicate errors or other types of sensor malfunction. The LED lamps can be multicolored and preferably three or more so that a combination of colors, brightness and persistence or intermittent flashing depict different states of operation. As an alternative or an additional option to the speaker 250, a headphone jack 260 can also be mounted for personal listening. Instead of the headphone jack 260, wireless output can be implemented as an output of the built-in audio amplifier circuit. The motion sensor 120, and lean sensor 121 and other and components of the device are drawn in an oversized view for sake of clarity. They can be miniaturized for practical and aesthetic appeal.

Figure 2:
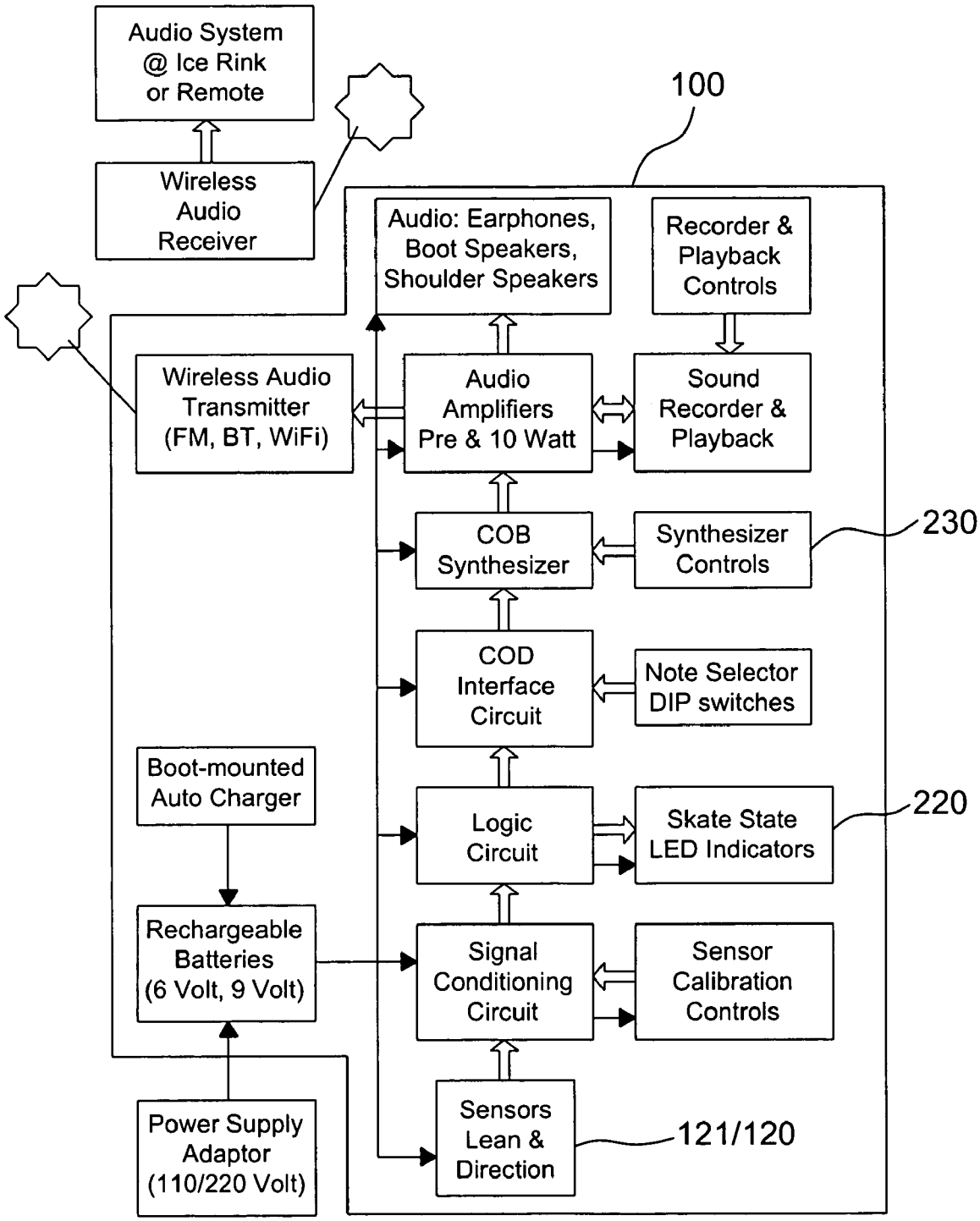
FIG. 2 illustrates a block diagram of the sensory and electronics modules of the musical skate according to one embodiment of the invention.

As can be seen in FIG. 2, the device may be organized in a block diagram as shown. The black solid thin arrows indicating direct current supply and the white wide arrows indicating data flow. The block diagram shows that the rechargeable batteries can be charged by an external power supply, or boot mounted charger. In the case of a roller blade, a wheel of the roller blade may charge the boot. If a generator is mounted in a single wheel of a roller blade, such as the generators commonly used for illuminating a roller blade with light elements, the electricity generated can be used to recharge the batteries. The generators typically have a higher rotational speed before range of activation so that they do not pose a substantial hindrance on the movement of the skater. Therefore, the block diagram does not require both a boot mounted charger and a power supply adapter. The block diagram suggests that either one is sufficient. The rechargeable batteries can obviously be replaced with non rechargeable batteries. In any case, the rechargeable batteries provide power to the sensors, signal conditioning circuit, logical circuit, interface circuit, synthesizer, audio amplifiers, and optionally the speakers. The sensor calibration controls, and lean and direction sensors feed into the signal conditioning circuit that provides the logical circuit with input of the skate state. The skate state can be output in the lamp indicators 220. The skate state is fed into the logic circuit that in turn provides a note selection output that is modified possibly by an octave and instrument selector physically implemented as switches or buttons included with the synthesizer controls 230. A synthesizer that is controlled by the input form the logic circuit and additional synthesizer controls 230 generates the musical output. The audio output can then be pre amplified and further amplified either for wireless broadcasting or speaker output.

Implementations of the Calibration Controls

Ordinary musical instruments such as a piano, guitar, violin or cello require tuning. The musical skate device may require calibration before use. Calibration is necessary because the conditions of the ice especially temperature and humidity can affect the preset thresholds of the sensors. Also, the skater may want to achieve a particular quality of performance with increased or decreased physical effort in terms of speed and lean on the edges such as the volume thresholds of FIG. 7.

There are at least three different implementations of the calibration system. Calibration electronics can be mounted directly in the box and exposed on its surface by means of calibration trimpots that can be mechanically adjusted with a screwdriver. Also, calibration can be automatic. Alternatively, the skate can be calibrated by wireless input so that the screwdriver is not necessary. It is obvious to use a remote control to eliminate switch and button clutter on the device. Certain remote control units are commercially available that can be both mass produced and custom mapped at low cost. Calibration can be by a glove with mounted miniature toggle switches which digitally adjust the voltage comparator thresholds of the sensor inputs. The glove can be connected wirelessly or can be directly wired to the electronics box on the side of the boot. A special IR remote control can be used to adjust the settings of the voltage comparators.

For easy calibration and function confirmation, visual indicators 220 may confirm sensor operation. One way is a color LED matrix 220 with different LEDs representing different edges. For the convenience of the skater these LEDs can be mounted: on the fingers of the skaters gloves; on the surface of the boot; on a patch attached on top of the front of the skater's boot; or on the periphery of specially designed glasses. The preferred choice can be left to the skater.

Cusp Detector for One Foot Turns

To expand from the basic 8 notes in an octave to include 5 half tones and to allow for transitions from any note to any other note, the device uses the fact that in skating turns on one foot such as 3-turns, brackets, counters, and rockers all employ one of two possible kinds of rotation known in the skating jargon as cusps, Clock Wise (CW) and Counter Clock Wise (CCW). The cusp detector detects fast CW or CCW turns. In one physical embodiment this cusp detector can be implemented as a second differential pressure sensor mounted on the heel of the boot with the High and Low pressure inputs facing side ways and perpendicular to the normally forward/backward gliding motion of the skates. The cusp detectors mounted on the left and right boots allow only for transition from even-to-even notes—"ETE transitions" (Re, Fa, La, Do') when turns are done on the right foot and odd-to-odd notes "OTO transitions" (Do, Mi, Sol, Si) when the turns are done on the left foot. Note that the cusp detector allows for the identification of two different ways of performing ETEs and OTOs—one with CW cusp and the other with CCW cusp. This in turn allows for the incorporation of transition from full notes (white keys) to half notes (black keys) and vice versa.

Relative Foot Position Detector for Foot-to-Foot Transitions (Steps)

To complement the cusp detector and to allow for the detection of even-to-odd (ETOs) and odd-to-even (OTEs) note transitions between the black and the white keys and vv, the musical skates feature another set of detectors, which detect the relative position of the boots such as parallel to each other; crossed in front or behind and one foot gliding or swinging ahead of the other or behind the other. One physical implementation of this detection system is by means of two sets 4 IR beacons mounted on the periphery of each boot in well defined positions such as 0/12-3-6-9 o'clock or 1-5-7-11 o'clock. Correspondingly, electronic circuits designed to interpret the signals of the IR beacon detectors are used to control the appropriate note selection. Notice that the relative position detectors allow for the identification of two kinds of ETOs and OTEs (Mohawks and Choctaws)—Open and Closed, which correspond to and complement the CW and CCW.

In the process of creating/playing a musical piece on ice, the choice of a given transition between two edges on the same foot (e.g., a three-turn versus a bracket or a rocker versus a counter) performed by the user will depend on the transition that will follow immediately after the exit edge of the current turn in the musical/dance sequence. The objective is to make the following transition easier and more natural.

For instance, a LFO 3-turn is suitable for the Do-Mi-Do sequence where a LFO bracket followed by a swing of the right free foot during which the Left skating foot passes through neutral (no lean) is suitable for playing of the Do-Mi-Mi note sequence. A similar approach is true in the choice of open vs closed Mohawk or Choctaw when playing transitions between odd and even notes and vice versa.

Another aspect that can be measured is the PUSH into and PULL from a turn or change of lean element. To achieve maximal efficiency and speed while performing a footwork/musical sequence, every edge should be associated with a push or a pull from the free (non-skating) foot. These are accomplished by forward (Pull if moving forward or Push if moving backward) and backward (v.v.) swings of the free foot. The pushes and pulls of the free foot can be used to modulate the quality of the notes generated by the skating edge. The modulation can be in terms of volume, inflections, and other musical parameters.

FIG. 3 shows a truncated list of the common abbreviations used in standard figure skating terminology (see. The 2006 Official U.S. Figure Skating Rule Book. Published August 2005 by U.S. FIGURE SKATING, Colorado Springs, Colo. 80906-3697 www.usfigureskating.org pp. 440). This list streamlines the mapping description and combination examples. Some combination examples would thus include: clCho (closed Choctaw); RFO (Right Forward Outside edge); opMo (open Mohawk); XswCho (cross swing Choctaw). The abbreviated notation would be clCho, clCho, opMo, XswCho.

FIG. 4 tabulates the preferred mapping of bold-face first column as well as alternative mappings of the skating states to musical notes. Therefore, the preferred mapping of the musical note Do or C is a left forward outside skating state. Left forward outside is abbreviated as LFO.

Similarly, the musical note D translates to an RFI or a right forward inside edge. Left is abbreviated with the letter L and right is abbreviated with the letter R. Forward is abbreviated with the letter F and back is abbreviated with the letter B. Outside is abbreviated with the letter O and the inside is abbreviated with the letter I. The first column relates to the first skate-state-to-note mapping embodiment. The second column to eighth column relate to the remainder of the embodiments.

FIG. 5 illustrates the common one-foot skating turns and two-foot transitions, which enable the skater to produce any desirable transition between two notes in an octave. Turns are differentiated by the choice of edges used to enter and exit the turn, the rotation toward or away from the edge (CW or CCW). Since they can be done in both directions (forwards and backwards) this leads to a large number of combinations.

For those that are not immediately familiar with figure skating notation and terminology, a brief glossary of terms is described below.

Three-turn: Change directions into the curve while simultaneously changing edges. A RFO three-turn consists of a RFO edge into the turn, a CW turn, and RBI edge after the turn.

Bracket: Change directions away from the curve while simultaneously changing edges. In a CW circle, a RFO bracket would consist of a RFO edge into the turn, a CCW turn, and a RBI edge after the turn.

Counter: This is a combination of a bracket (the entrance) and a three-turn (the exit). This turn should only change directions; there is no edge change on a counter turn. A RFO counter consists of a RFO edge into the turn, a CCW turn, and a RBO edge after the turn.

Rocker: This is just the opposite of a counter. A three-turn is used for the entrance and the exit is a bracket. There is also no edge change in a rocker. A RFO rocker consists of a RFO edge into the turn, a CW turn, and a RBO edge after the turn. Once again, the skater would exit to a CCW circle.

In addition to one foot turns, a variety of possible steps from one foot to the other using different entry and exit edges completes the spectrum of possible note transitions.

Mohawk (inside): Change directions into the curve with a change of feet, but no edge change; movement continues along the same circle. In a CCW circle, a RFI Mohawk would start on the right foot with a RFI edge into the turn, a CCW turn onto the left foot, with a LBI edge on the exit. The tracings on this turn should resemble a one foot three-turn.

Mohawk (outside): Change directions away from the curve with a change of feet, but no edge change; movement continues along the same circle. In a CW circle, use a RFO edge into the turn, a CCW turn onto the left foot, with a LBO edge on the exit. The tracings on this turn should look similar to a one foot bracket turn.

Choctaw (inside): The entrance for this turn is always a forward inside edge. The skater changes direction away from the curve, changes feet, change edges, and the movement exits then to a circle in the opposite direction. In a CCW circle the skater leads with a RFI edge, turns CCW onto the left foot, and exits with a LBO edge into a CW circle.

Choctaw (outside): The entrance for this turn is always a forward outside edge. Once again, the skater changes direction away from the curve, changes feet, change edges, and the movement exits to a circle in the opposite direction. Leading with a RFO edge in a CW circle the skater would turn CCW onto their left foot and exit with a LBI edge into a CCW circle.

In addition to inside and outside Mohawks and Choctaws there are also the so called open and closed ones. They differ in the position of the stepping foot with respect to the skating foot in the moment of the transition, which can be in front or behind as a result of which the hips of the skater end up in an "open" or "closed" position after the step, and the free foot after the step is extended towards or away from the direction of the skaters glide on the ice.

FIG. 5 also illustrates the transition from one foot to the other (e.g. Mohawks and Choctaws), which enable the skater to produce any desirable transition between an even (e.g. Re, Fa, La, Do') and an odd (e.g., Do, Mi, Sol, Ti) note in an octave.

In the current embodiment, the sensor and skate state directly correspond to musical notes. In another embodiment of the invention, a rhythm can be included so that ice dancing is easier. The rhythm only changes notes in intervals so that change of notes necessarily coincide with measures and beats. The skate state at the instance of a beat will dictate the note for the duration of the beat. The rhythm and beat are pre recorded, but the skate dancer implements the skate state.

FIG. 6 shows an example of a skating pattern in which the skater plays the C Major musical scale Do(C) to Do'(C') and back in a 4/4 rhythm (e.g. Tango or Foxtrot). This pattern has been generated by the software described in this document. In this figure, forward edges are drawn with thick lines while backward edges are drawn with thin lines. Also, Left foot edges a drawn with black lines while Right foot edges are drawn with gray lines. The Inside or Outside lean on an edge is depicted by the curvature of the individual line segments (arches). Notice that the overall appearance of the pattern will depend on the choice of number of beats per circle which is reflected in the depth of lean of the skater while skating a given lobe as well as on the number of beats per step which is defined by the chosen musical score. This gives a degree of freedom to the performer who is using the musical skates to modify the skating pattern and consequently the choreography of the performance while sticking with a predetermined musical score.

To illustrate the potential of the Natural Musical Order of Skating (NMOS) rules of taking a piece of music and mapping it to a skating pattern, FIG. 6 shows the patter generated form the "Twinkle, Twinkle Little Star" baby lullaby. When a skater wearing the musical skates executes this baby rattle like pattern on the ice, the musical skates device will play the melody. Notice that this is a closed pattern, which illustrates the power of NMOS to create complete self contained ice dance patterns similar to the compulsory ice dance patterns in the Figure Skating Rule Book.

FIG. 7 is a possible way of mapping the angle of tilt to the volume of the note. The sound volume played by each edge can be controlled by the depth of the edge which can vary form 0 degrees to about 45 degrees angle and the corresponding sound volume can be from low to high. In effect this mimics the ability of a piano or other classical instrument player to notes softly of hard and loud.

Depending on the type of instrument, which is electronically emulated by the synthesizer, the note produced by each instrument can have different duration. For instance, a drum on cymbal will produce only a short beat-like sound when the skate first touches the ice while a violin or piano emulation will produce a sustained sound lasting until the duration of the edge contact with the ice.

In another improvement of the device, the forward or backward speed of the skate relative to the ice, which is measured by the pitot tube like speed sensor and can be as high as 10 m/s, can be used to control in a threshold manner the choice of instruments automatically with higher pitch instruments being triggered at higher speeds and lower timbre instrument mapped to lower speeds. Alternatively, the speed of the skates can control reverberation of the notes that are played. In high-speed embodiments, implementation of precision anemometer technology may be practical.

Bend sensors attached along the ankle forward/backward bend line can also be used to modulate the sounds produced by the musical skate. Two or 3-D accelerometers can also be used to capture the clockwise or counterclockwise rotation of the skater during turns, twizzles (moving turns) and spins and convert them to musical experiences.

Specially designed additional IR emitter/receiver based electronic circuit, mounted on the 4 corners of each skating boot (FO, FI, BI, BO) by being embedded into a skate slipper, will enable the detection of the mutual relationship of the skates during skating in real-time. This allows the musical skate to detect and differentiate between skating footwork such as crossovers and progressive steps forward and backward, open and closed Mohawk, skate slips, etc. The signals generated in this manner can be used to generate yet another set of musical experience for instance a drum beat at the cross of the feet during the Silver Harris Tango steps or cymbal sound during the rapid crossed slips in the Cha-Cha Congelado steps (see the Figure Skating Rulebook).

Many advanced ice dancers and skaters such as Oksana Grishuk or Sergei Yagudin include in their footwork stepping on toe picks or the hills of the blades. Yet another improvement of the device adds Toe Pick Dance Detectors. This can be achieved by means of jiggle switches or directional shock sensors. The signals from these sensors can be mapped to musical expressions as well.

Another improvement of the device is user programming and mapping of edges to notes by using a PIC and user accessible control like a thumb wheel, or wirelessly enabled laptop computer. This can enable the user to personalize musical skating which might be useful for instance if she likes some particular footwork pattern to be associated with some particular musical expression.

Yet another improvement of the device focuses on the fact that the batteries that power the device have to be recharged or replaced periodically (typically after a few hours of skating). An embodiment of the well known electromagnetic induction principle can be used in this case to eliminate the need to recharge periodically an replace this with continuous charging during skating. Devices such as the Ever-Lasting Electric Torche™ are on market. A sealed plastic tube may be mounted under the boot along the blade. A strong permanent magnet in the shape of a metal cylinder is placed inside the tube and allowed to slide freely forward and backward during the swings of the skate in the process of stroking or leg swinging/extensions. A densely wind electric coil is placed around the cylinder. When the magnet moves back and forth in the tube, electricity is generated in the coil. A special electronic circuit is connected to the coil and switches the current flow in such a way that it charges a rechargeable battery connected to the circuit. With an appropriate design the amount of electricity generated by this system can exceed the amount of electricity that is used by the musical skate and as a result the musical skate can be turned into a fully self contained electronic device.

Another improvement of the Natural Musical Order of Skating (NMOS) takes into account the existence of half tones (e.g., C#, etc.) and maps them to skating states. One possible such mapping is when the half-tones map to crossed skates. Intuitively, when two consecutive notes overlap the two feet are crossed while each one of them skating on the corresponding edge. One such example is an "Inna Bower" position (RFO & LBI) which maps to Do' & Mi played simultaneously. In contrast, if the skater wants to play two consecutive notes on the scale at the same time this can be accomplished by two-footing on the corresponding edges but without crossing the feet. An example is an inside "spread eagle" (RFI & LBI) that maps to Re and Mi played simultaneously.

An important feature that differentiates the process of making music with the musical skate as compared to making music with any other musical instrument is that the music generated by the musical skate can be seen as an unintended and completely complementary side effect of skating. This is due to the fact that while on the ice the skater skates and therefore goes thorough all edges and consequently generates note by each consecutive edge contact with the ice. This can be done completely unconsciously and without any special effort by the skater. In other words making music with the musical skates is a natural by product of skating. On the contrary, making music with any other musical instrument requires a conscious interaction of the musician with the musical instrument. This intrinsic feature of the music creation by the musical skate enables the user to experience the generated music continuously during skating in the form of auditory feedback. This gives the user a unique opportunity to not only evaluate the complexity and the quality his/her own skating as reflected by the music generated by the musical skate but also to react immediately and appropriately in order to improve both the difficulty and quality of the skating and consequently of the music making.

An important and potentially very beneficial feature of the musical skate, which can be especially useful to ice dancers is its ability to clearly differentiate between skating on one foot vs double footing. The latter often happens when a skater does not have appropriate balance during the process of transferring his/her weight from one foot to the other as a result of which both feet are momentarily on the ice simultaneously (defined as two-footing). This is something that coaches and ice dance judges are monitoring closely and penalizing accordingly during scoring of tests or competitions. While recognizing that two-footing is often difficult, the musical skate gives immediate and audible feedback of the occurrence of this phenomenon.

Potential Applications of the Musical Skate

The musical skate can be used in training exercises for skaters. Since it heavily relies on the execution of high quality edges on the ice, practicing with the musical skate can successfully replace the recently abandoned figures exercises. Figures were for many years one of the elements of skating both in practice, tests and competitions which required a high degree of quality edge work. They are one reason why skating was called figure skating. However, figures were all along considered to be boring and both skaters and the skating audience especially the TV audience lost interest. The invention of the musical skate can potentially revive interest in figure by adding a musical component. The auditory feedback from the skates of a skater executing figures can be both beneficial to the skater, and helpful to a figures judge who in the past had to stand on the ice and visually inspect the traces on the ice, and also can be entertaining to some audiences.

In addition to skating Figures the musical skate can be used to augment and enhance the training for the so-called Moves In the Field (MIF) tests, which are further detailed in Figure Skating Rulebook.

Used in live performances, the musical skates can be an instrument for entertainment and as in any entertainment the audience wants to see the performer doing something interesting to create the music. The musical skates naturally fulfill the common goal of a performance system, namely to make the audience understand the correlation of gesture and sound.

Naturally, music engages the performer in a creative activity that tells her something about herself, and is 'sticky'—makes the performer want to stay with it. The best musical instruments are those that are easy to learn and take a lifetime to master. The musical skates can naturally fall in this category.

Expanding the Musical Range of the Musical Skate

It is obvious that there are not enough edges between the two skates to represent all keys in a full scale piano keyboard. A standard piano keyboard usually has keys for up to seven or eight octaves with thirteen keys per octave. This limitation of the simple NMOS mapping can be easily overcome by realizing that a piano keyboard repeats a set of 13 keys (and octave) multiple (from one to eight) time depending on its size.

The musical skate may solve this problem by introducing an octave selector switch. There are at least two possible embodiments of such selector switch: it can be embedded as a set of mini toggle switches mounted on the four fingers of the skater's gloves and triggered by the skater's thumb or it can be also implemented as two flex/bend sensors mounted under the skater's armpits as part of the skaters costume or shirt. The response of these sensors can be graded in up to seven levels (one per each octave) and can be used as the octave switching trigger.

Figure 8:
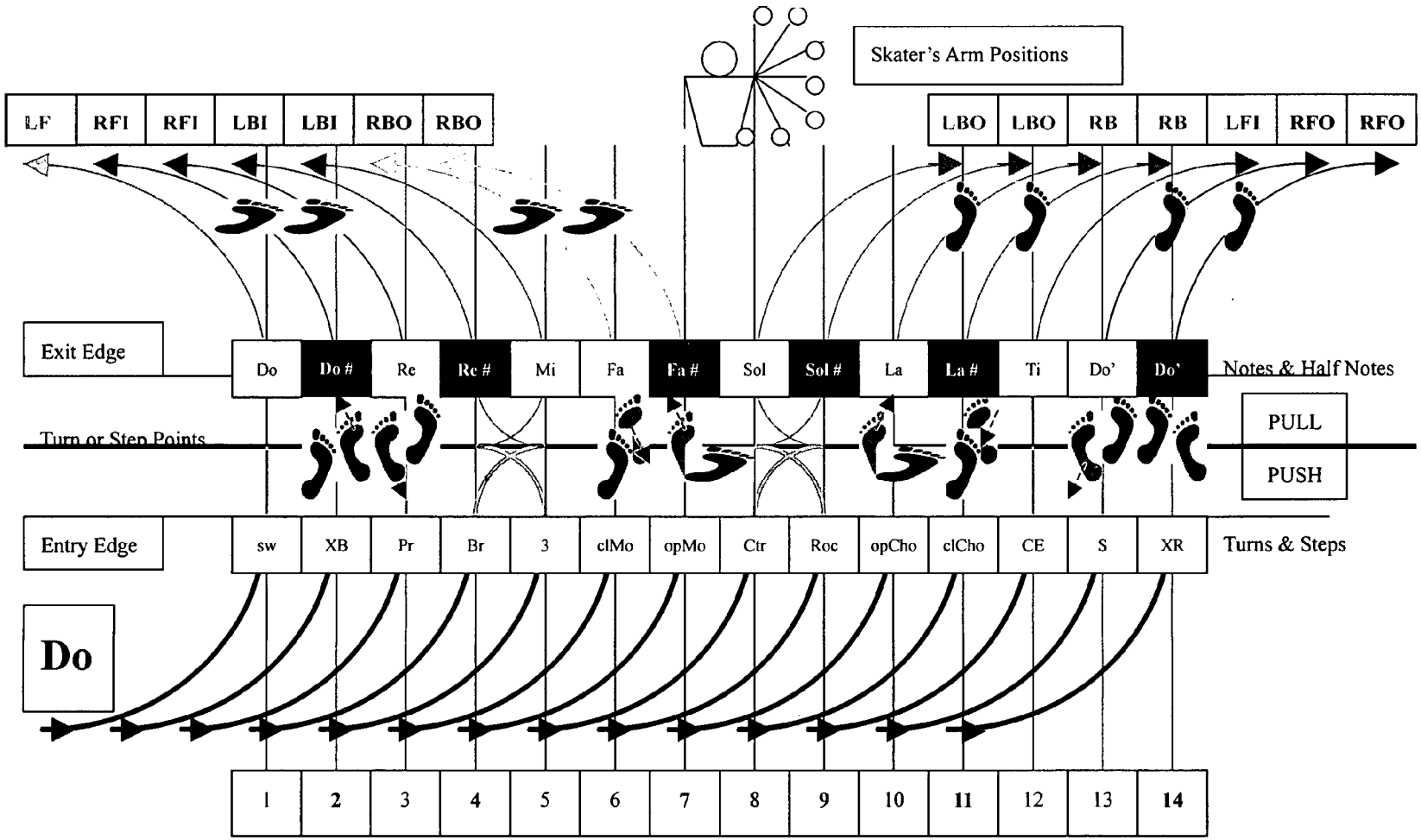
FIG. 8 is a graphical table showing transition from note Do to any other note of an octave including sharps and flats.

As seen in FIG. 8, this implementation will make the skater look much like a conductor of an orchestra waving his hands up and down. When any of the arms of the skater is down next to the body the notes that the skater plays with her corresponding foot will be in a low octave (C1). Lifting the arms gradually will switch to higher octaves with Middle-C (C4) played when the arms are horizontal (the most natural position of arm placement during skating) and the highest octave played when the hands are straight up by the ears.

Expressing Music Dynamics

The music dynamics changes in a course of a music piece. These changes can be slow over several notes or phrases or sudden in a single note. For instance, the theory and practice of music recognizes: El Niente—do nothing (glide on ice in exit position with the free foot skate close to the shin); Sudden and abrupt changes: sf (sfz)—Sforzando (strong sudden accent); Gradual changes (of depth of lean): cresc (crescendo)—gets gradually louder; decrescendo (decresc) or Diminuendo (dim)—get gradually softer. The musical skate implements such changes in the music dynamics by gradually or abruptly changing the angle of lean on an edge; or by pulling on or pushing on an edge, which increases or decreases the speed of gliding.

Playing Musical Chords

An entertaining and pleasing musical dimension to playing a classical musical instrument such as a piano is the ability to play chords (several notes at the same time like DO, Mi Sol) or arpeggios—the same set of notes but in a rapid succession instead of together. The musical skate has the potential to emulate chord playing by allowing the skater to have both skates on the ice on different edges and with different relative positions of the legs. The number of possible chords is large but can be potentially matched using the numerous degrees of freedom the musical skate allows.

Performance Samples: from Music to Edges and from Ice Dances to Music

Existing ice dance patterns can be mapped to music generated by musical skates. Alternatively, conventional sheet music scores can be converted to dance patterns produced by the NMOS and performed in real time by a skater equipped with the musical skates. To facilitate the skater in preparation for her musical skates performance, this conversion process can be also done in an off-line mode. A computer software program can be written, which takes as input musical scores (a sequence of notes), coverts them into a sequence of skating steps and turns of corresponding durations in beats and draws this sequence as a new dance pattern, which consequently can be executed by the skater. Conversely, a published skating pattern such as the dance and the moves in the field patterns in the Figure Skating Rule Book can be written down as a sequence of notes that can be played on instruments other than the musical skates. Admittedly such musical scores may not sound very pleasing to the ear but if memorized by a skater as a melody, they may help a skater in learning a previously unknown dance pattern. In this sense, the feedback that the musical skates provide can be in both directions—from music to skating and from skating to music. Therefore the musical skates can be potentially used as an instrument for teaching skating and music in parallel.

The device described in this invention can turn ordinary skates into an electronic musical instrument. Much like all contemporary electronic musical instruments that transform the human hands' or feet's interaction with artificial keyboards or drums into synthesized sounds, skates can be played and when connected appropriately to electronic synthesizers, they can produce music. Of course, one can argue that most electronic instruments like the piano, drums, and guitars allow for almost infinite variety of possible sounds related to a multitude of inherent degrees of freedom. On such instruments one can play single notes up and down the scales spanning multiple octaves. One can combine multiple notes in rapid sequences; one can be soft and gentle or forceful and reckless.

In light of the present invention the feet of a skater can thus be compared with the trained fingers of a musician. Skates allow for a large number of degrees of freedom. These degrees of freedom stem from the selection and depth of edges, the direction and speed of motion, the alteration of the skates' contact with the ice and also from the unlimited number of transitions between these basic elements such as turns, jumps, skids, spins, etc. There are many degrees of freedom allowing limitless expression possibilities. In addition, when musical instruments like the piano are played the musician often uses the foot-controlled pedals to modify the sound output of the instrument produces by the fingers. Conversely, the skater can use her arms and fingers connected to additional sensors and/or switches to modify and expand the sound performance range of the musical skates.

Potential for Commercialization of the Musical Skates

The device can be commercialized relatively inexpensively since it is constructed from parts and electronic components, which are readily available on the international market. The electronic circuits that compose the device have been used in thousands of battery operated electronic toys already on the market.

Therefore, while the presently preferred form of the musical skates has been shown and described, and several modifications thereof discussed, persons skilled in this art will readily appreciate that various additional changes and modifications may be made without departing from the spirit of the invention, as defined and differentiated by the following claims. It is to be understood that the present invention is not limited to the sole embodiment described above, but encompasses any and all embodiments within the scope of the following claims.

The invention claimed is:

1. A musical ice skate comprising:

a boot for wearing by a user;

a skate with a blade for gliding on ice;

wherein the skate is mounted to the boot;

an electronic module which comprises:

a sensor assembly comprising a differential air pressure sensor for detecting forward and backward gliding velocity of the musical ice skate, and a left infrared distance measuring sensor and a right infrared distance measuring sensor, wherein the left infrared sensor and the right infrared sensor are mounted to face the ice, wherein the left infrared sensor and the right infrared sensor detect an amount of inside tilt from about 0° when the blade is perpendicular to the ice to about 45° the maximum lean before the side of the boot touches the ice and detect an amount of outside tilt from about 0° to about 45°, wherein the sensor assembly receives input signals from the air pressure sensor and the left infrared sensor and the right infrared sensor and outputs an output signal corresponding to a skate state; and a logic circuit converting the output signal corresponding to the skate state into a musical note output which has a pitch, a volume, and a duration, wherein the volume of the musical note output is proportional to the amount of inside tilt, or proportional to the amount of outside tilt, such that the volume increases, the closer the left infrared sensor or the right infrared sensor is to the ice;

further comprising a first state, a second state, a third state, and a fourth state, wherein the first state is mapped to a first musical note, wherein the second state is mapped to a second musical note, wherein the third state is mapped to a third musical note, and wherein the fourth state is mapped to a fourth musical note, wherein a user can play a song by skating in a particular pattern, wherein there is no output when the pressure sensor assembly does not sense air flow, whereby the skate becomes a musical instrument.

2. The musical ice skate of claim 1, further comprising: a second differential air pressure sensor mounted on a heel of the boot with high pressure and low pressure inputs facing sideways in a direction roughly perpendicular to the blade, wherein the logic circuit converts transitions from any note to any other note by sensing one foot skating turns such as 3-turns, rockers, counters and brackets, which are either Clock Wise or Counter Clock Wise, wherein the second differential air pressure sensor fast Clock Wise or Counter Clock Wise turns, which the logic circuit interprets as skate state transitions.

3. The musical ice skate of claim 1, further comprising: a relative foot position detector for sensing two-foot skating transitions including Mohawks and Choctaws in both open and closed position, which the logic circuit interprets as even to odd note transitions or odd to even note transitions.

4. The musical ice skate of claim 1, further comprising: a mapping of skating states wherein the first state is mapped to Ti or Do, wherein the second state is mapped to Do or Re, wherein the third the state is mapped to Mi or Fa and wherein the fourth state is mapped to So or Ra.

5. The musical ice skate of claim 1, further comprising a wireless transmitter for transmitting musical note output from the logic circuit.

6. The musical ice skate of claim 1, further comprising a mapping of skating states to musical notes wherein the first skate state is wherein the first state is mapped to Ti or Do, wherein the second state is mapped to Do or Re, wherein the third the state is mapped to Mi or Fa and wherein the fourth state is mapped to So or Ra; and further comprising a wireless transmitter for transmitting musical note output from the logic circuit.

7. The musical ice skate of claim 1, further comprising a relative foot position detector for sensing Mohawks and Choctaws in both open and closed position, which the logic circuit interprets as an even to odd note transition or an odd to even note transition, further comprising a mapping of skating states wherein the first state is mapped to Ti or Do, wherein the second state is mapped to Do or Re, wherein the third the state is mapped to Mi or Fa and wherein the fourth state is mapped to So or Ra.

* * * * *